US006349510B1

(12) United States Patent
Haas et al.

(10) Patent No.: US 6,349,510 B1
(45) Date of Patent: Feb. 26, 2002

(54) EQUIPMENT SHELTER FACILITIES

(75) Inventors: Harold Robert Haas, Shreveport; Scott Craig Leggett, Sr., Bossier City; Randall Cade Goodman, Ringgold, all of LA (US); John Irving Mathis, Richmond, KY (US)

(73) Assignee: GFRC Shelters, Shreveport, LA (US)

( * ) Notice: Subject to any disclaimer, the term of this patent is extended or adjusted under 35 U.S.C. 154(b) by 1058 days.

(21) Appl. No.: 08/811,142

(22) Filed: Mar. 3, 1997

Related U.S. Application Data

(63) Continuation of application No. 08/552,924, filed on Nov. 3, 1995, now abandoned.

(51) Int. Cl.[7] ..... E04H 1/12
(52) U.S. Cl. ..... 52/79.5; 52/143
(58) Field of Search ..... 52/79.1, 79.5, 52/79.6, 143, 2.16, 2.17, 2.22, 69

(56) References Cited

U.S. PATENT DOCUMENTS

| | | | | |
|---|---|---|---|---|
| 3,057,054 A | * | 10/1962 | Barnes | 52/2.17 X |
| 3,057,368 A | * | 10/1962 | Seaman | 52/2.17 |
| 3,122,985 A | * | 3/1964 | Osborne | 52/2.17 |
| 3,415,582 A | * | 12/1968 | Trexler | 52/2.22 X |
| 3,908,901 A | * | 9/1975 | Newcomb et al. | 52/2.17 X |
| 4,046,462 A | * | 9/1977 | Fletcher et al. | 52/2.17 X |
| 4,293,969 A | * | 10/1981 | Frommelt | 52/2.22 X |
| 4,974,829 A | * | 12/1990 | Gamow et al. | 52/2.17 X |

OTHER PUBLICATIONS

Andrew Corporation, Bulletin 3580 (1/95), U.S.A.
Andrew Corporation, Bulletin 3581 (1/95), U.S.A.
Andrew Corporation, Bulletin 3582 (1/95), U.S.A.
Andrew corporation, "Equipment Shelters" (undated), U.S.A.

Bally Engineered Structures, Inc., "Low Cost Housing for High Cost Equipment," (undated), U.S.A.

Brochure, "DuPont Building, Inc." (undated), U.S.A.

Brochure, "Fibrebond" (undated), U.S.A.

Hartford Concrete Products, Inc. "Solve Your Equipment Housing Needs . . . " (undated), U.S.A.

* cited by examiner

*Primary Examiner*—Beth A. Stephan
(74) *Attorney, Agent, or Firm*—Bracewell & Patterson, L.L.P.; Shawn Hunter

(57) ABSTRACT

A single transportable oversized or extended support base is provided for a conventional equipment shelter and the associated power source. The shelter and power source are separately affixed to the base while at the place of manufacturing to form a transportable unitary shelter facility that is easily and efficiently installed at the use site. Such combination avoids the additional labor and expense associated with installing equipment such as a generator in a separate room within the building because it eliminates the need for the extra door, and larger wall, roof, and floor panels, ventilation systems, environmental controls and related items. The shelter facility and methods of the present invention also avoid the logistical problems associated with on-site external installation of auxiliary equipment because installation of the facility reduces the need to coordinate the activities of different people at a remote site and provides greater assurance to the manufacturer and the user that the installation has been done correctly and that everything will work as it should upon startup at the use site.

10 Claims, 2 Drawing Sheets

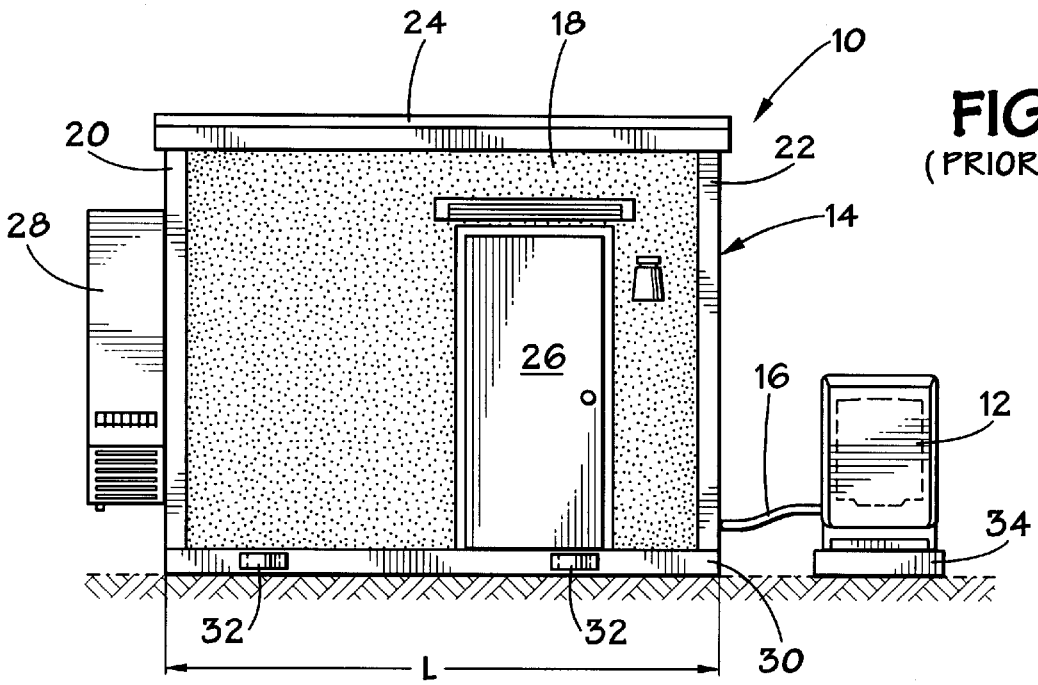
FIG. 1
(PRIOR ART)
FIG. 2
(PRIOR ART)
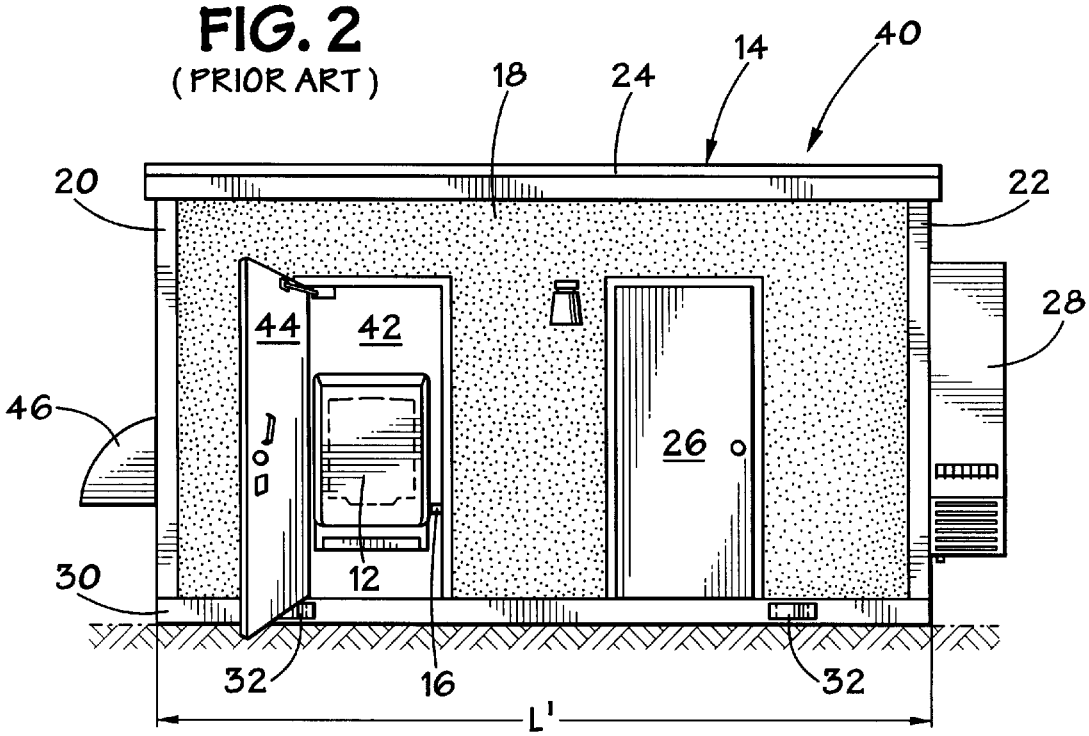

EQUIPMENT SHELTER FACILITIES

This application is a continuation of application Ser. No. 08/552,924 (now abandoned), filed on Nov. 3, 1995.

BACKGROUND OF THE INVENTION

A. Field of the Invention

The present invention relates generally to facilities and methods of constructing a shelter facility that includes a prefabricated building and associated external support equipment. More specifically, the invention relates to transportable equipment shelter facilities of prefabricated panel construction which are shipped with contained equipment to a site of use. The present invention also relates to the manufacture of shelter facilities using a single extended support base to support both the shelter and external support equipment.

B. Description of the Related Art

Equipment shelter facilities are commonly used to house and protect sensitive electrical equipment and devices from external hazards such as dirt, weather, animals and vandalism. Such facilities often house telecommunication equipment, fiber optic devices, analyzers or motor control equipment. Setup of a shelter facility typically requires emplacement of a prefabricated shelter, often at a remote or undeveloped site, and installation and testing of the machinery and equipment being housed within by trained specialists using tools and equipment that are often not conveniently transported and operated at such sites.

Normally, the shelter is constructed of wall, roof and floor panels made of prefabricated glass fiber reinforced concrete or similar materials. The completed shelter is sometimes affixed to lightweight metal skids and may be shipped as a unit to a site for installation. Upon arrival at an operational site, the shelter facility is normally placed in a location having a prepared foundation such as a preexisting concrete surface, footings or a concrete slab that has been poured and cured at the site specifically for supporting the shelter facility. These shelter facilities are then adapted at the operational site for service.

Electrical power to the shelter facility is a primary concern for the site user, and must be properly installed and operational soon after delivery of the building. Electricity may, of course, be available at some sites by connection with a preexisting power source such as an electrical substation or power line. Where such preexisting power sources are not available, or where a dedicated source of backup or emergency power to the facility is needed when primary power sources fail, a generator or other power source is usually installed either inside the shelter (see FIG. 2) or adjacent to the shelter with conduits carrying the wiring to the building (FIG. 1).

The advantages of placing the power source inside the shelter are that the equipment can be installed within the building during construction at the manufacturing plant, and the testing or repair of the equipment with the power connections already made may be conducted under ideal conditions where trained specialists, parts and equipment are readily available. Placing the generator inside the building during manufacturing also avoids some of the usual causes for time delay in completion of the facility, such as inclement weather and the logistics of coordinating variously skilled workers, specialists and equipment at an undeveloped site many miles away.

Often, however, such multifunctional use of the building is unsuitable, or it is economically undesirable as the end user must order a shelter large enough to accommodate all of the equipment. It is more costly to use a shelter that also houses the auxiliary equipment because of the added complexity of such structures. Generators, for example, must usually be installed in a separate room from the primary use room, which requires additional materials and manpower to construct. In addition, these separate power rooms require efficient ventilation systems for removal of generator exhaust gas and a source of cooling power to prevent generator overheating. Complexity and costs of construction, operation and maintenance climb further when environmental controls are included for the generator rooms. These added complications and expense are difficult to justify, since generator rooms are not useful for most other purposes. The increased security provided from placement of the power source within the shelter is offset for some users by the increased size and cost required by such shelters.

In many instances, the power source is already housed in a weather protective cabinet that may offer some protection from weather, vandalism or damage by animals. If additional security is desired, the equipment or the building and the equipment together are sometimes encircled by a security fence such as a chain link fence topped with barbed wire.

Separately delivering and installing the auxiliary equipment is often a more economical alternative to an interior generator room. However, certain disadvantages are still present. One or more trained specialists must go to the operational site, make the proper connections and test, adjust or repair the equipment. Specifically, wiring a stand-alone generator, for example, to a building complicates the installation process, requiring the coordinated efforts of variously skilled individuals at remote sites. Conduit must be run from the generator to the building and the wires must be pulled through the conduit and connected at the building and the generator. Only upon installing and filling the liquid propane tank and testing the equipment at the site can it be determined if the generator and the apparatus inside the building are working together properly. If inadequately tested at startup, damage to a generator may remain undetected until power from the inoperable generator is needed. Furthermore, the variable quality of on-site connections from the generator to the building increases the chances that the facility will fail on startup or will malfunction later on. For example, the generator may perform inappropriately either by unexpected and unnecessary operation or by a failure of the generator to operate when needed.

A practical method of installing auxiliary equipment for use with a building that provides adequate protection to the equipment, provides easier testing and repair of the equipment, and alleviates some of the logistical problems associated with set-up and operation at a remote site location would be a valuable addition to the industry.

SUMMARY OF THE INVENTION

The present invention provides a single oversized or extended support base for a conventional equipment shelter and the associated power source. The shelter and power source are separately and permanently attached to the base while at the place of manufacturing to form a transportable unitary shelter facility that is more easily and efficiently installed at the use site. Such combination avoids the additional labor and expense associated with installing equipment such as a generator in a separate room within the building because it eliminates the need for the extra door, and larger wall, roof, and floor panels, ventilation systems, environmental controls and related items. The shelter facility and methods of the present invention also avoid the logistical problems associated with on-site external installation of auxiliary equipment because installation of the facility reduces the need to coordinate the activities of different people at a remote site and provides greater assurance to the manufacturer and the user that the installation has been done correctly and that everything will work as it should upon startup at the use site.

By using the method of the present invention, a manufacturer can fully install and test out the equipment, such as an emergency power system, for example, before it is sent to the site.

The entire equipment shelter and attached emergency power system of the present invention is transportable in that it can be picked up and moved from the installation site to another location, if desired. In fact, it could be moved to a location where there is no commercial power available and it would be ready to run anyway. The support base provided by the present invention is also capable of accepting additional wall and roof sections in the event the customer would like to extend his building on site. Other objects and advantages of the invention will appear from the following description.

BRIEF DESCRIPTION OF THE DRAWINGS

A detailed description of a preferred embodiment of the invention reference will be made by reference to the accompanying drawings wherein:

FIGS. 1 and 2 depict prior art shelter facilities.

DETAILED DESCRIPTION OF THE PREFERRED EMBODIMENT

Figure 3:
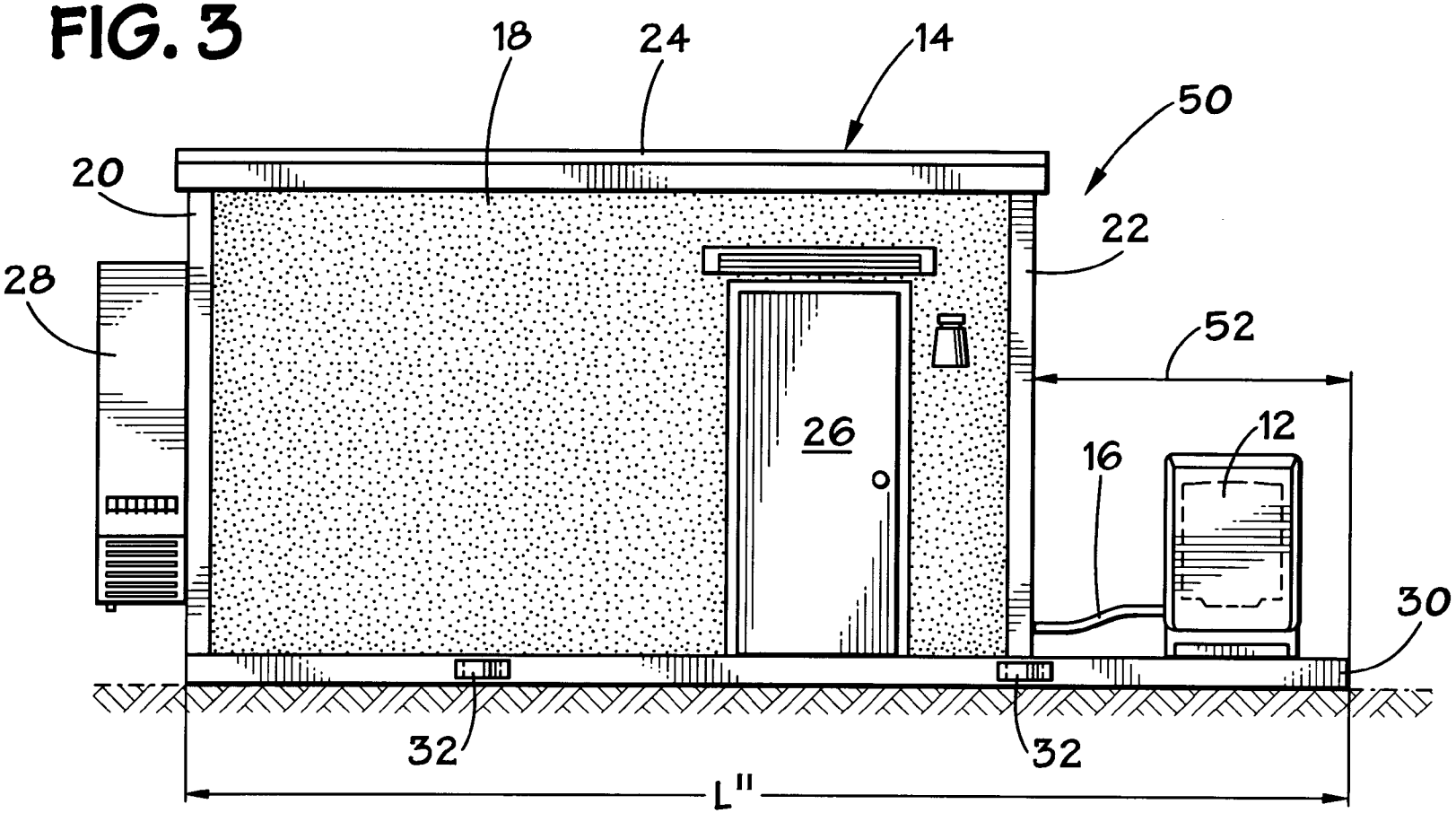
FIG. 3 illustrates an exemplary embodiment of a shelter facility of the present invention.

The following description is provided of transportable shelter facilities, methods of constructing such facilities and making them operational. Certain aspects, such as the connection and securing of shelter paneling, are well known in the art and will not be described in any detail. Like or similar components among the arrangements described are given the same reference numerals for the sake of clarity. Two alternative prior art shelter facility arrangements are depicted in FIGS. 1 and 2.

FIG. 1 shows a typical shelter facility 10 of the type where the power source 12 is located outside of the shelter 14 and interconnected by means of a power connection 16. The shelter 14 is comprised generally of a front wall panel 18, two side wall panels 20 and 22, and a rear wall panel (not shown). A floor panel (not shown) may be included within the shelter 14 to which each of the wall panels 20, 22 are attached. A roof panel 24 is affixed to the top of the shelter 14 for substantially complete enclosure of the interior area of the shelter 14. The panels of the shelter 14 are preferably constructed of precast glass fiber reinforced concrete but may be metal frame panels or other suitable materials. An access door 26 and an environmental control, such as an air conditioning unit, 28 are also provided. In the arrangement of FIG. 1, the shelter 14 is affixed upon a transportable support base 30 which has a length L approximately the same as that of the roof panel 24, front wall panel 18 and rear wall panel of the shelter 14. The support base 30 is equipped with lift points 32 so that it may be raised and lowered for delivery to an operational site. The power source 12 is located proximate the shelter 14 upon a separate support foundation 34 which is typically a separately poured and cured preexisting concrete pad, footing or other foundation.

FIG. 2 depicts a prior art shelter facility 40 wherein the power source 12 is located within the shelter 14 in a secondary room 42 which is provided with a second access door 44. The power connection between the power source 12 and housed electronic or mechanical components (not shown) is provided within the shelter 14. A vent 46 is shown which allows additional air to be communicated between the secondary room 42 and the exterior of the shelter 14. It is pointed out that the transportable base 30 is of an extended length L' which is approximately that of the roof panel 24, front wall panel 18 and rear wall panel of the shelter 14.

Referring now to FIG. 3, an exemplary shelter facility 50 is depicted which is illustrative of the apparatus and methods of the present invention. The support base 30 has a length L" which is greater than that of the roof panel 24, front wall 18 and rear wall such that a power source support area 52 is provided on the upper surface of the support base 30. The power source 12 is affixed to the power source support area 52 exterior to and adjacent to the shelter 14.

In the embodiment shown in FIG. 3, the support base 30 extends outward from the shelter 14 beyond only one wall panel 22, but it may also extend outward beyond the opposite wall panel 20 to provide an additional area for mounting additional pieces of equipment, either at the manufacturing plant initially, or later on at the use site, if desired.

The shelter 14 and power source 12 are preferably assembled for delivery to the remote site together, as a single transportable unit. While at the manufacturing facility, the power source 12 is installed outside building 14 on the power source supporting portion 52 of the support base 30. Construction of a shelter facility in accordance with the present invention generally includes assembling the shelter 14 by attaching the wall and roof panels 18, 20, 22, 24 to a steel support frame (not shown) and affixing the resultant structure to the support base 30 to form the shelter 14. Weather-resistant techniques such as step-jointing are preferably used. The shelter 14 may also be insulated if desired. The power source 12 is also mounted upon the base 30 and a power connection 16 is preferably established between the power source 12 and the shelter 14 so that the components housed within the shelter 14 are provided with power.

The present invention has been described in terms of particular embodiments found or proposed to comprise preferred modes for the practice of the invention. It will be appreciated by those of skill in the art that, in light of the present disclosure, numerous modifications and changes can be made in the particular embodiments exemplified without departing from the intended scope of the invention.

What is claimed is:

1. A transportable shelter facility for housing equipment to be protected, the shelter facility comprising:

a. a support base having a first length and comprising a shelter support portion and a power source support portion, the power source support portion being outward beyond the shelter support portion upon said support base;

b. a shelter affixed to the shelter support portion of the support base, the shelter having a second length which is less than the first length; and c. a power source affixed to the power source support portion of the support base.

2. The shelter facility of claim 1 further comprising a power connection operably interconnecting the shelter and the power source.

3. The shelter facility of claim 2 wherein the shelter is formed of prefabricated wall and roof panels, at least one of the wall panels being affixed to the support base.

4. The shelter facility of claim 2 wherein the power source comprises a generator.

5. A method of constructing a transportable shelter facility comprising the steps of:

a. providing a structural base;

b. securing a shelter to a portion of the base, the shelter defining an interior area and an exterior area; and c. securing a power source to a portion of the base in the exterior area from the shelter.

6. The method of claim 5 further comprising the step of establishing a power connection between the shelter and the power source.

7. A method of establishing an operational shelter facility comprising the steps of:

a. assembling a transportable shelter facility having a support base presenting a shelter support area and a power source support area, the power source support area being outward beyond the shelter support area on the support base, a shelter having a second length which is less than the first length mounted upon the shelter support area, and a power source mounted upon the power source support area;

b. transporting the shelter facility to an operational site.

8. The method of claim 7 wherein the step of assembling the transportable shelter facility further comprises establishing a power connection between the power source and the shelter.

9. A transportable shelter facility for housing equipment to be protected, the shelter facility comprising:

a. a shelter comprised of a plurality of walls and having a shelter length;

b. a power source;

c. a single support base having a length which is greater than the shelter length;

d. both the shelter and the power source being affixed to the support base; and e. the support base being transportable for movement of the transportable shelter facility to or from a location.

10. The transportable shelter facility of claim 9 wherein the power source is located exterior and adjacent to the shelter.

* * * * *